US006588612B1

(12) United States Patent
Dorn et al.

(10) Patent No.: US 6,588,612 B1
(45) Date of Patent: Jul. 8, 2003

(54) PLASTIC CONTAINER WITH STACKING RECESSES

(75) Inventors: James C. Dorn, Norton, OH (US); Richard A. Lovelace, Jr., Akron, OH (US); John P. Reynolds, Akron, OH (US); Richard C. Darr, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/138,134

(22) Filed: May 2, 2002

Related U.S. Application Data

(63) Continuation-in-part of application No. 29/155,115, filed on Feb. 4, 2002, which is a continuation-in-part of application No. 29/154,168, filed on Jan. 17, 2002.

(51) Int. Cl.[7] ..... B65D 1/02; B65D 23/00; B65D 23/10

(52) U.S. Cl. ..... 215/10; 206/509; 206/510; 220/23.6

(58) Field of Search ..... 215/10; 206/509, 206/510; 220/4.26, 23.4, 23.6

(56) References Cited

U.S. PATENT DOCUMENTS

| | | | | | |
|---|---|---|---|---|---|
| 3,369,658 | A | * | 2/1968 | Hasselmann | 220/23.6 X |
| 3,369,688 | A | * | 2/1968 | Dike | 315/10 |
| 3,889,834 | A | * | 6/1975 | Harris, Jr. | 215/10 |
| 4,351,454 | A | * | 9/1982 | Maynard, Jr. | 215/10 X |
| 4,372,455 | A | * | 2/1983 | Cochran | 215/398 X |
| 4,609,106 | A | * | 9/1986 | Gentili | 215/10 X |
| 4,805,793 | A | * | 2/1989 | Brandt et al. | 215/10 |
| 4,881,647 | A | * | 11/1989 | Schiemann | 215/10 X |
| 5,064,101 | A | * | 11/1991 | Richter et al. | 215/10 X |
| 5,462,169 | A | | 10/1995 | Dygert et al. | |
| 5,497,899 | A | | 3/1996 | Wuerfel | |
| 5,642,833 | A | | 7/1997 | Ring | |
| 6,045,036 | A | | 4/2000 | Ring | |
| 6,050,455 | A | | 4/2000 | Soehnlen et al. | |
| 6,068,161 | A | | 5/2000 | Soehnlen et al. | |
| 6,098,649 | A | * | 8/2000 | Noguchi et al. | 220/23.6 X |
| 6,230,892 | B1 | | 5/2001 | Przytulla et al. | |
| 6,276,549 | B1 | * | 8/2001 | Fasci et al. | 220/23.6 X |
| 6,338,415 | B1 | | 1/2002 | Grob | |

FOREIGN PATENT DOCUMENTS

| | | | | |
|---|---|---|---|---|
| DE | 1187181 | * | 2/1965 | 215/10 |
| DE | 2541580 | * | 3/1977 | 215/10 |
| FR | 2287387 | * | 5/1976 | 215/10 |
| WO | 02/12077 | | 2/2002 | |

* cited by examiner

*Primary Examiner*—Sue A. Weaver
(74) *Attorney, Agent, or Firm*—Robert H. Bachman

(57) ABSTRACT

Stackable plastic container including side portions having at least one of protrusions and depressions which nest with one of matching protrusions and depressions of a second container, and with the bottom portion including depressions which nest with the pouring spout and handle of a second container.

15 Claims, 9 Drawing Sheets

PLASTIC CONTAINER WITH STACKING RECESSES

CROSS REFERENCE TO RELATED APPLICATIONS

This application is a Continuation-In-Part of copending U.S. patent application Ser. No. 29/154,168 for CONTAINER BODY PORTION, filed Jan. 17, 2002, and copending U.S. patent application Ser. No. 29/155,115 for CONTAINER BODY PORTION, filed Feb. 4, 2002.

BACKGROUND OF THE INVENTION

Plastic containers are widely used commercially for a variety of products. These include plastic containers of widely varying sizes depending on the particular product and the commercial needs. For example, it is not uncommon to have plastic containers having a capacity of one gallon, two gallons, or more.

It is highly desirable to provide a plastic container which is stackable while at the same time providing desirable commercial characteristics, such as convenience in use and handling, reusability and desirable aesthetic characteristics. Also, the container must be able to be securely stacked as on a pallet in multiple tiers without requiring intermediate stacking pallets. Secure stackability is particularly important for hazardous liquids. Moreover, bulky or large size plastic containers present a particularly difficult problem for stackability in view of their often flexible walls.

Accordingly, it is a principal objective of the present invention to provide a plastic container which is stackable.

It is a further object of the present invention to provide a stackable, plastic container as aforesaid which has desirable commercial characteristics, such as reusability and pleasing aesthetic features.

It is a still further objective of the present invention to provide a stackable container as aforesaid which can readily be stacked in multiple tiers and which can be prepared in a variety of container sizes.

Further objects and advantages of the present invention will appear hereinbelow.

SUMMARY OF THE INVENTION

In accordance with the present invention, the foregoing objects and advantages are readily obtained.

The plastic container of the present invention comprises:

a blow molded plastic bottle having side portions thereof, a bottom portion thereof connected to said side portions, and a top portion connected to said side portions, wherein said side portions extend downwardly from said top portion and interconnect the top portion to the bottom portion;

a pouring spout on the top portion thereof;

a handle on the top portion thereof;

wherein said side portions each include one of (1) at least one protrusion, (2) at least one depression, and (3) combinations thereof, which nest with one of matching protrusions and depressions of a second blow molded container; and wherein said bottom portion includes depressions which nest with the pouring spout and handle of a second blow molded container.

Desirably, the container is characterized by each side portion including at least one protrusion and at least one depression spaced from each other.

Preferably, the container includes four of the side portions to provide an essentially square container.

In accordance with a preferred embodiment, the protrusions and depressions extend laterally across each of the side wall portions, and preferably continuously extend across at least fifty (50) percent of each side wall portion.

Further features of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

Figure 1:
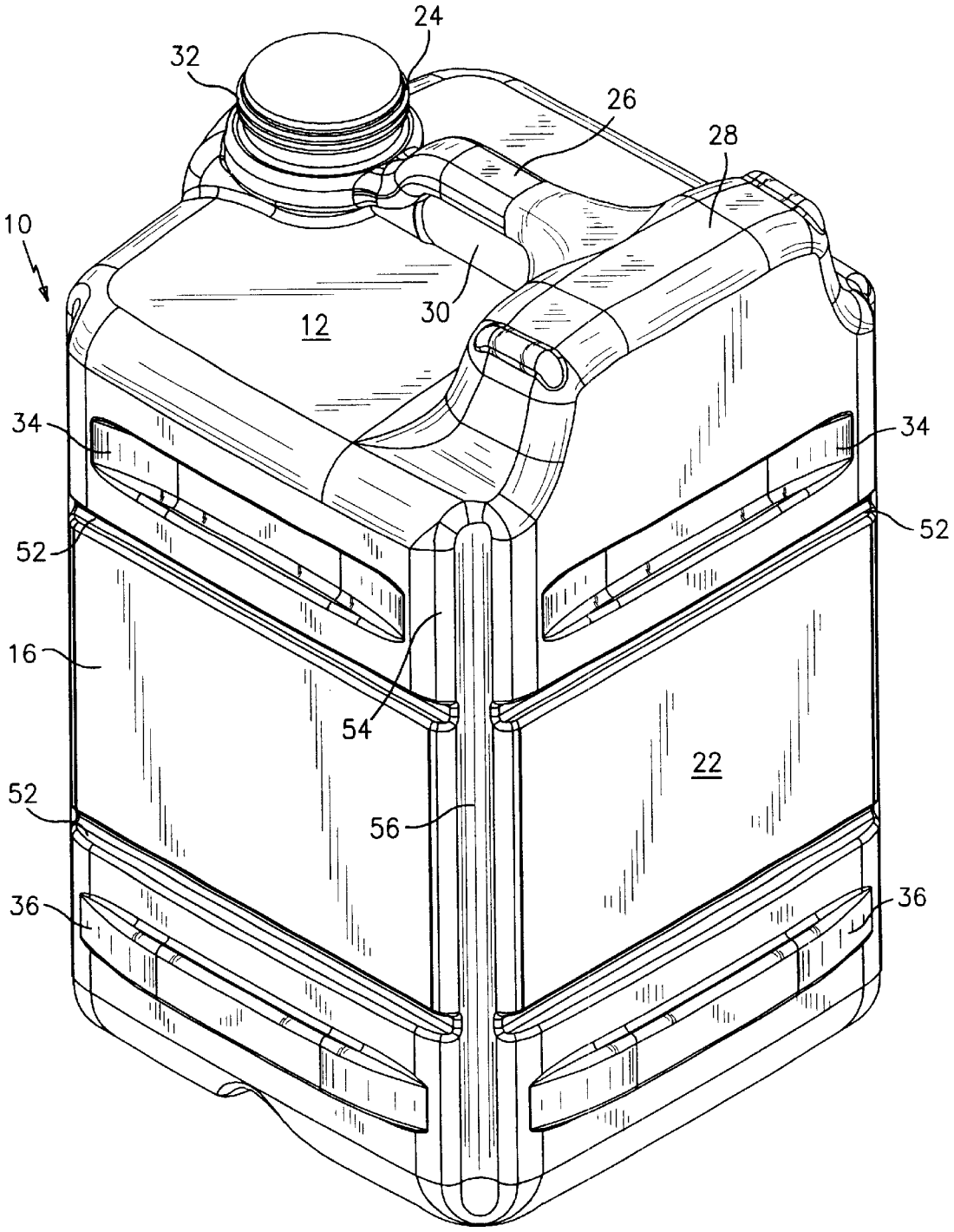
FIG. 1 is a perspective view of one embodiment of the container of the present invention.
Figure 2A:
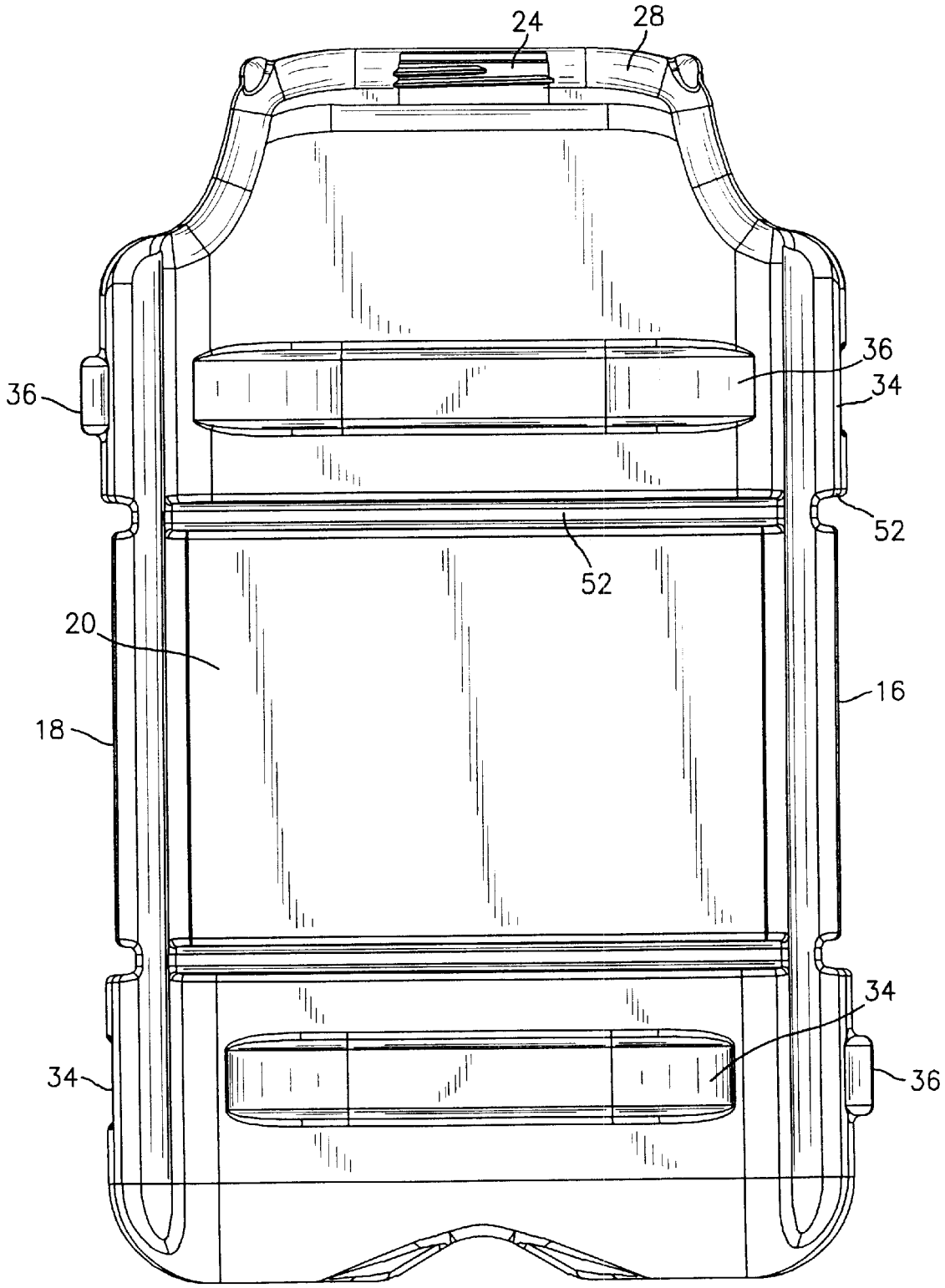
FIG. 2A is a front elevation view of the container of FIG. 1.
Figure 2B:
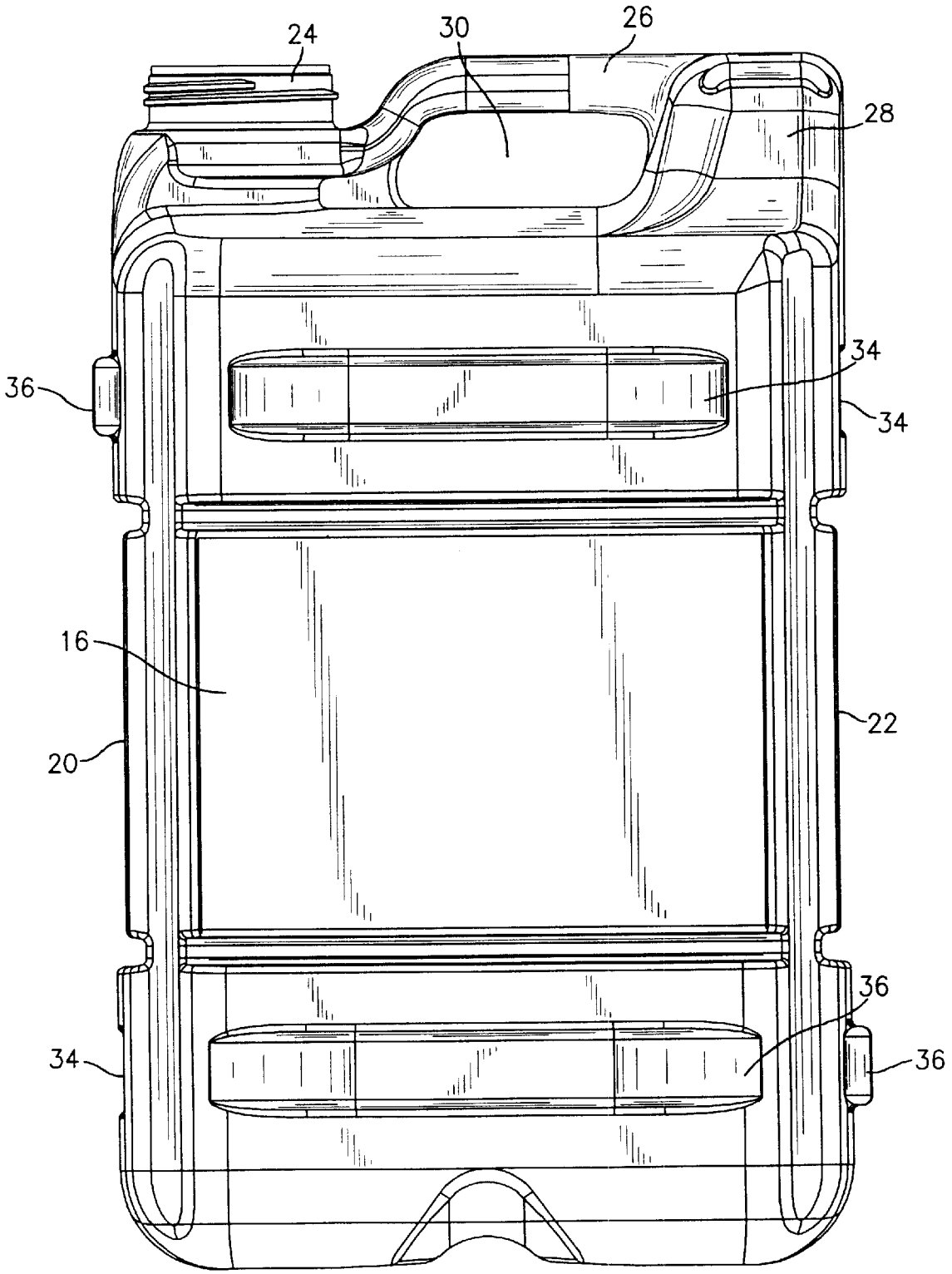
FIG. 2B is a left side elevation view of the container of FIG. 1.
Figure 2C:
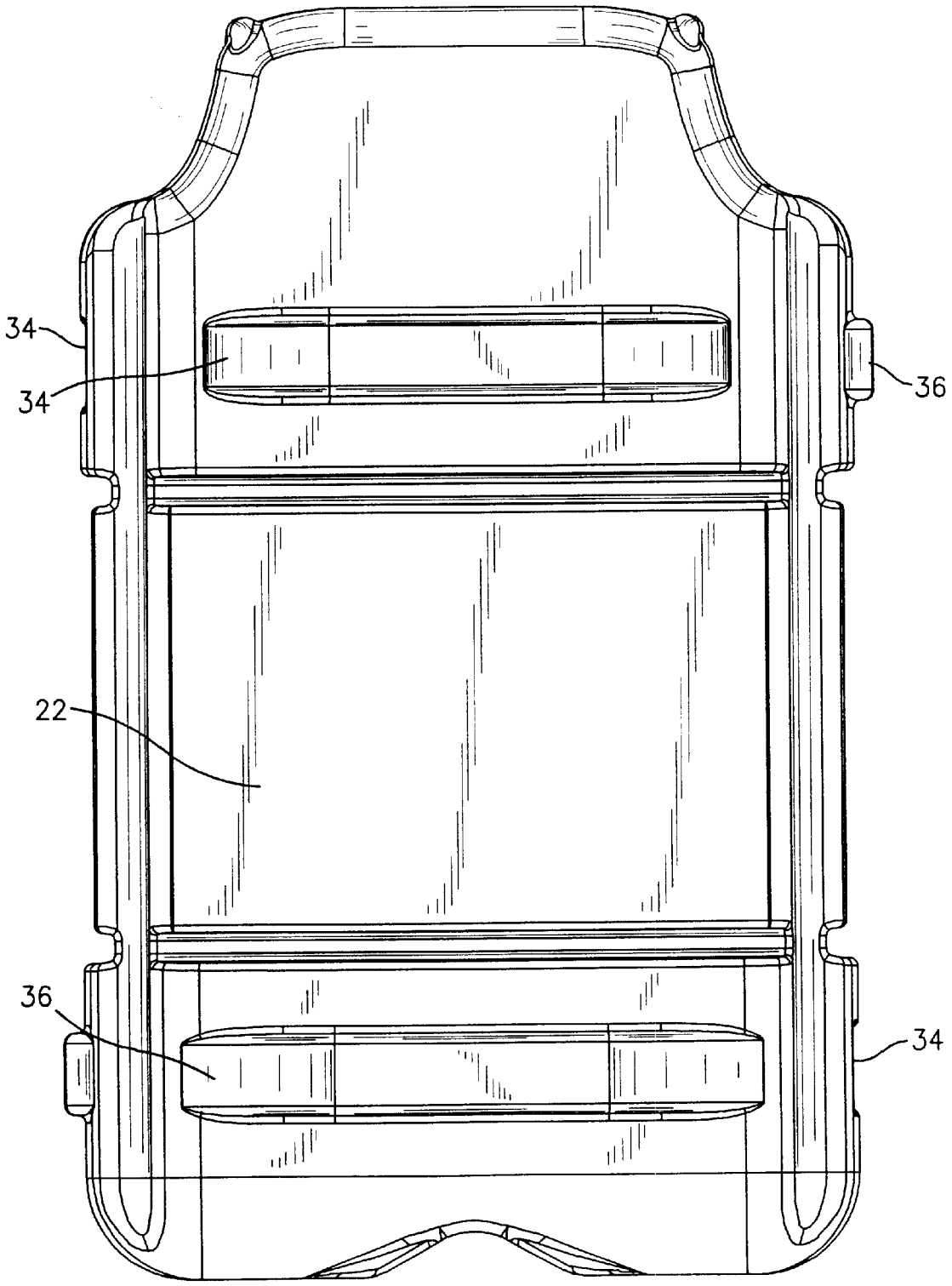
FIG. 2C is a rear elevation view of the container of FIG. 1.
Figure 2D:
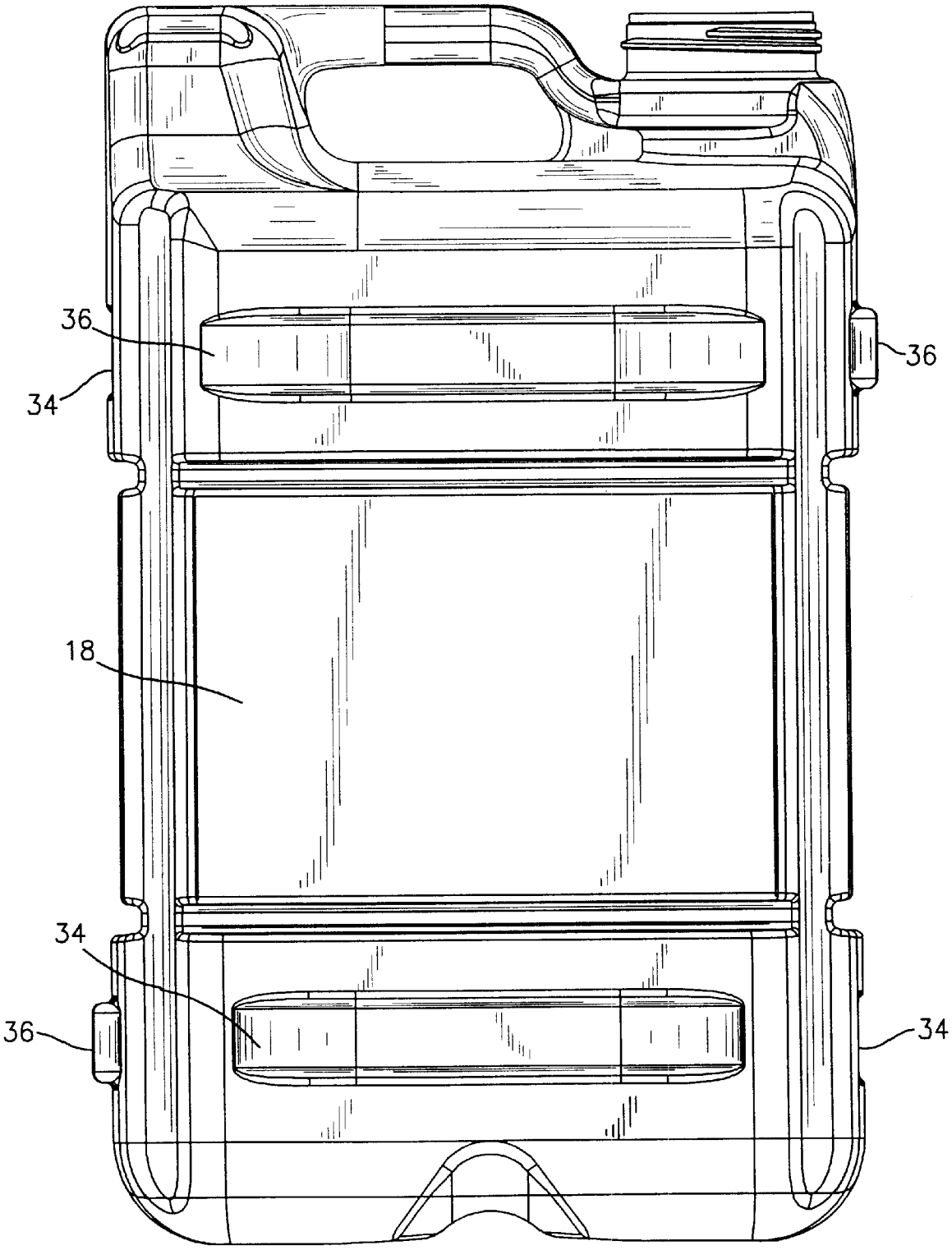
FIG. 2D is a right side elevation view of the container of FIG. 1.

Referring to the drawings, FIG. 1 shows a perspective view of a preferred embodiment of a container of the present invention. As shown in FIGS. 1–4, the container 10 is a blow molded plastic container having a top portion 12 (see FIG. 3), a bottom portion 14 (see FIG. 4) and four side wall portions, namely, a left side portion 16 (see FIG. 2B), a right side portion 18 (see FIG. 2D), a front side portion 20 (see FIG. 2A), and a rear side portion 22 (see FIG. 2C). As clearly shown in the drawings, bottom portion 14 is connected to side wall portions 16, 18, 20 and 22, and top portion 12 is also connected to side wall portions 16, 18, 20 and 22. Moreover, the side portions extend downwardly from the top portion and interconnect the top portion to the bottom portion to provide a container 10 with an essentially square configuration.

In addition, top portion 12 is provided with a pouring spout 24, a handle 26 and an upstanding shoulder portion 28, wherein the handle 26 extends between the pouring spout and shoulder portion 28. Space 30 beneath handle 26 provides an 141 easy and convenient means to grasp the container 10. Pouring spout 24 may conveniently be provided with external threads 32 for receiving a screw-on cap.

As shown in the drawings, each of the side portions include at least one of protrusions and depressions or combinations thereof. Therefore, each side portion can have one or more protrusions or one or more depressions, or a mix of one or more protrusions and one or more depressions. Thus, referring to FIG. 1, left side portion 16 and rear side portion 22 each include upper depressions 34 and lower protrusions 36. The depressions and protrusions on each side wall are desirably spaced from each other and extend laterally across the respective portions. Thus, left side portion 16 includes an upper depression 34 which is continuous and which extends across at least 50% of the left side portion. The left side portion also includes a lower protrusion 36 which is also continuous and which also extends across at least 50% of the left side portion. Rear side portion 22 includes a corresponding continuous upper depression 34 and a continuous lower protrusion.

On the other hand, front portion 20 (FIG. 2A) and right side portion 18 (FIG. 2D) each include upper protrusions 36 and lower depressions 34. The depressions and protrusions are similarly spaced from each other as on rear portion 22 and left side portion 16 and similarly extend laterally across the respective portions. Thus, front portion 20 includes an upper protrusion 36 which is continuous and which extends across at least 50% of the front portion. The front portion 20 also includes a lower depression 34 which is also continuous and which also extends across at least 50% of the front portion. Right side portion 18 includes a corresponding continuous upper protrusion 36 and a continuous lower depression 34.

Figure 5A:
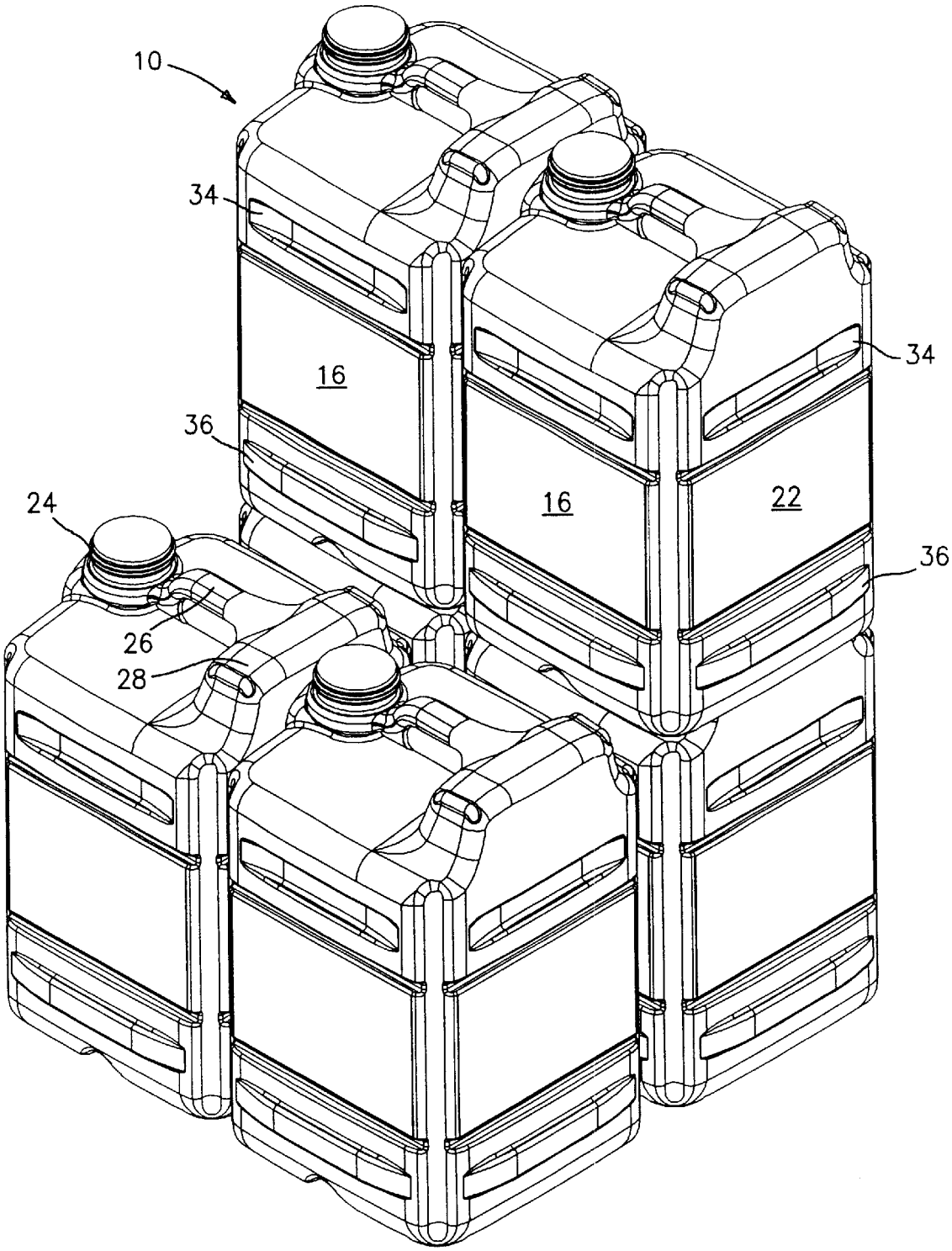
FIGS. 5A and 5B are perspective views showing two embodiments of the containers of the present invention in partially stacked configurations.

Thus, in the nested configuration partially shown in FIG. 5A, the upper protrusions on one container match with and nest in the upper depressions on adjacent containers, and the lower protrusions on said container match with and nest in the lower depressions on an adjacent container, to provide a firm, nested side-to-side container arrangement as shown.

Figure 3:
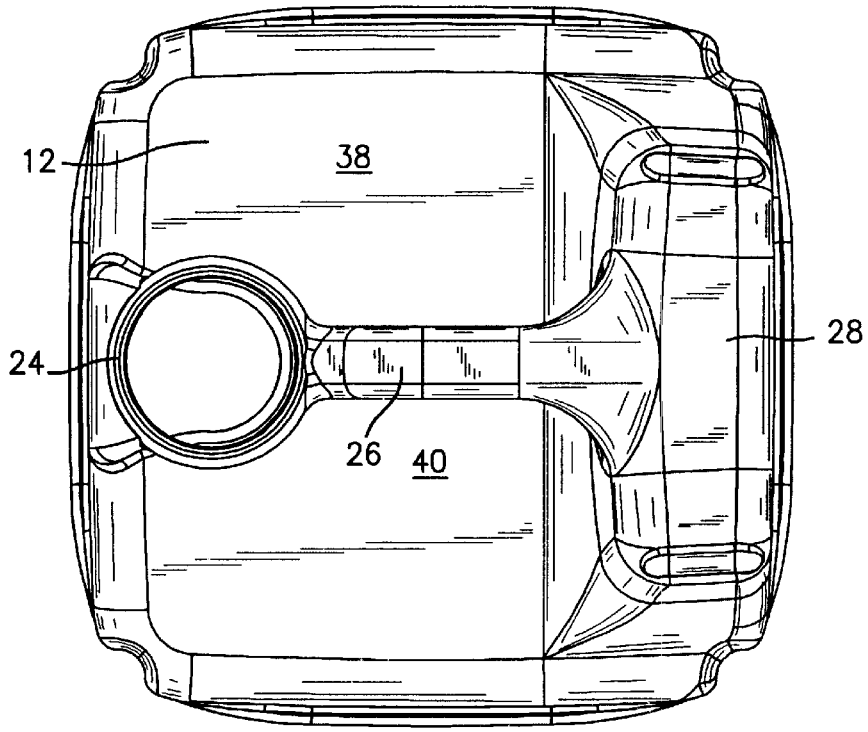
FIG. 3 is a top view of the container of FIG. 1.
Figure 4:
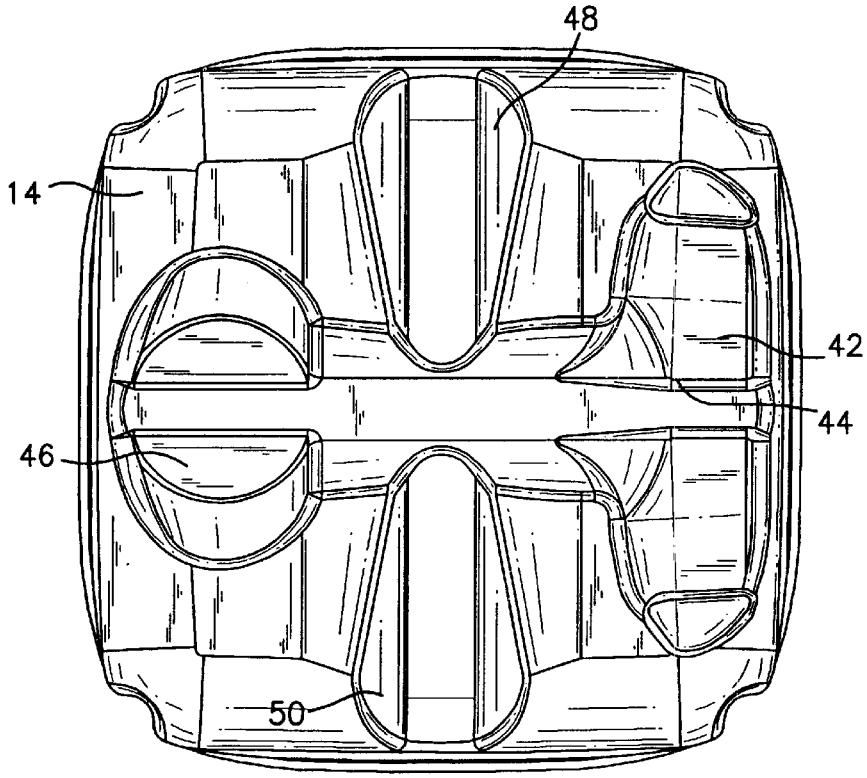
FIG. 4 is a bottom view of the container of FIG. 1.

Referring to FIGS. 3 and 4, top portion 12 includes a pouring spout 24, handle 26 and shoulder 28, as described above. Handle 26 is centrally located on top portion 12, and the top portion includes depressed areas 38 and 40 on either side of the handle. Bottom portion 14 includes a first depression 42 which nests with shoulder portion 28 of a second container, a second depression 44 which nests with the handle 26 of a second container, and a third depression 46 which nests with the pouring spout 24 of a second container. In addition, bottom portion 14 includes protrusions 48, 50 which nest with depressed areas 38, 40, respectively. Thus, as clearly shown in FIG. 5A, the containers are also nested top to bottom in addition to side-to-side to provide a firm, stable nested engagement.

Figure 5B:
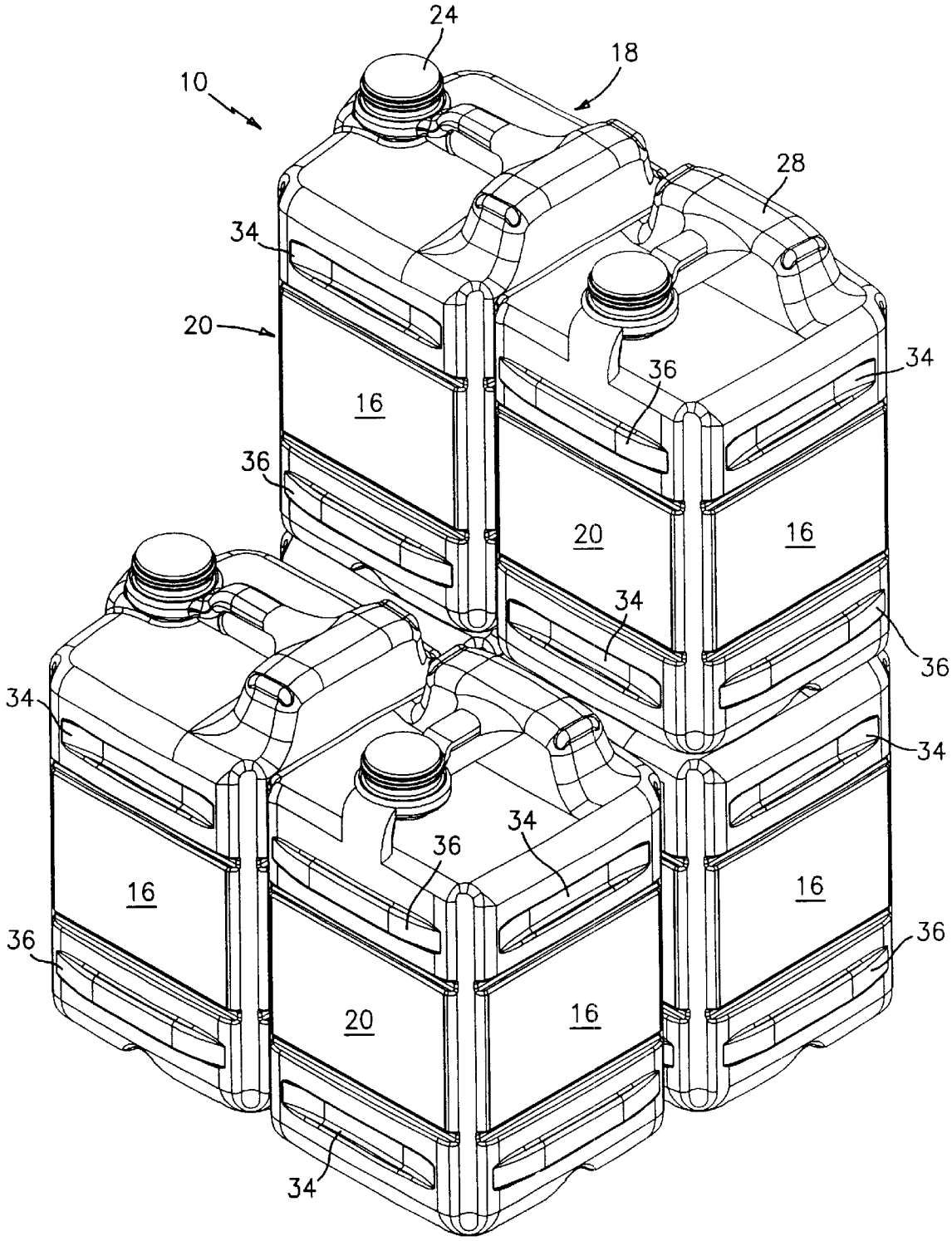

FIG. 5B shows an alternate stacking arrangement for the container 10 of FIG. 1, wherein the containers are rotated 90° side-by-side to provide a stable, stacked arrangement. Alternatively, one can alter the location of the protrusions and depressions to enable the containers to be rotated 180° with respect to the side-by-side adjacent container, also to provide a stable, stacked arrangement. Thus, the location of protrusions and depressions provide considerable versatility to possible stacking arrangements. Thus, for example, a front-to-back stacking arrangement can be obtained by providing one container with protrusions and depressions as shown in FIG. 1 and reversing the protrusions and depressions in alternate containers. Thus, sides 16 and 22 in the alternate containers would have upper protrusions and lower depressions, and sides 18 and 20 would have upper depressions and lower protrusions, enabling front-to-back stacking of alternate containers.

The container of the present invention can be any convenient and desirable size, although the configuration is particularly convenient for large size containers, as 1 to 5 gallon containers. Naturally, the smaller the container, as for example, those less than one gallon, the higher one can stack the containers. For example, for 2 to 5 gallon containers, it may be desirable to stack no more than 3 or 4 containers high. Naturally the containers can be readily and conveniently stacked on pallets and transported thereon. Advantageously, a single pallet can be used for a stack of containers.

Each of the left and right side, front and rear portions should be provided with at least one of the depressions or protrusions, although two or more of the depressions or protrusions or combinations thereof are preferred for stability, especially for the larger containers. A preferred configuration is for each of the four sides having a continuous, laterally extending protrusion and depression as shown in FIGS. 1–4, although one could readily have two or more protrusions on two sides and two or more depressions on two sides. Alternatively, each of the four sides may have three or more of the protrusions and/or depressions or combinations thereof. One could provide any desired and convenient mix of protrusions and depressions on each of the four sides. Of course, one should insure that the protrusions and depressions nest with appropriately similarly configured depressions and protrusions on adjacent containers.

Especially for the larger size plastic containers, the asides may include at least one rib 52 extending laterally across each side, generally and preferably parallel to the protrusions and depressions. The rib is desirably an inward depression as shown, but an outward projection can-also be used. Two such ribs are shown on each side in FIGS. 1–5, but a larger number can readily be used on each side as desired. The ribs provide structural support and are particularly desirable for the larger size plastic containers. Also, they are desirable for smaller, light weight plastic containers.

Any desired plastic material can be used, but polyethylene is preferred.

The edge portions 54 of the container between the four side portions desirably include recessed portions 56 which aid in preventing bulging of the plastic containers. These edge recesses provide additional structural support. Naturally, the exact configuration thereof can vary as desired.

Figure 6:
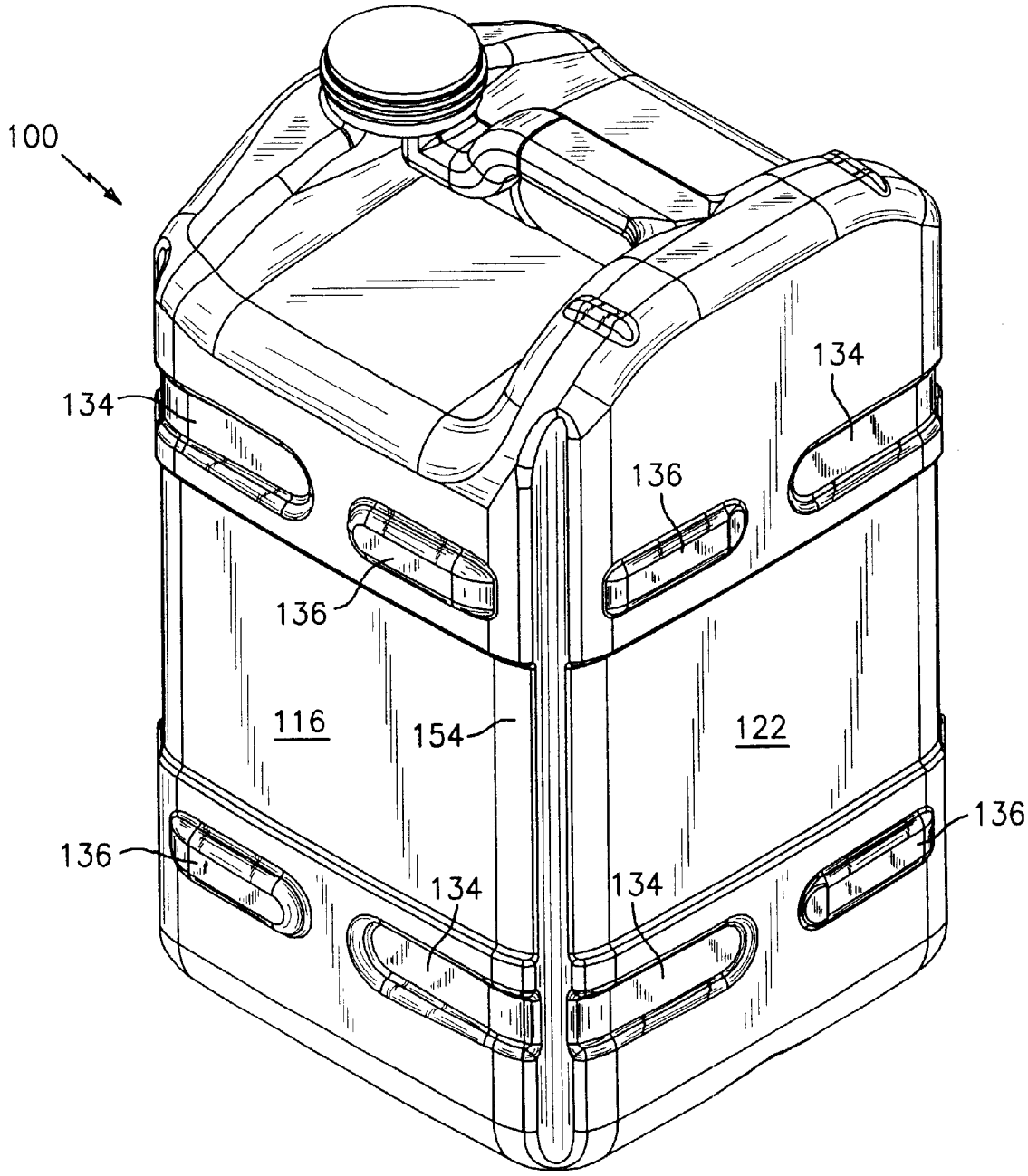
FIG. 6 is a perspective view of an alternate embodiment of the container of the present invention.

In the alternate embodiment of FIG. 6, container 100 is shown with each side portion including discontinuous depressions and protrusions across each side with the total length of both on each side in end-to-end relationship being at least 50% of each side portion. Thus, left side portion 116 includes upper depression 134 and upper protrusion 136 in end-to-end relationship, each extending part way across the left side portion, and lower protrusion 136 and lower depression 134 also in end-to-end relationship, each extending part way across the left side portion. Rear side portion 122 also includes a combination of discontinuous protrusions and depressions, with rear side upper protrusion 136 being oriented adjacent to left side upper protrusion 136, and rear side lower depression 134 being oriented adjacent to left side lower depression 134. Also, as shown in FIG. 6, either the protrusions and/or the depressions can extend onto the edge portions 154, if desired. Containers 100 may be advantageously set up in a nested configuration as shown in FIG. 5. Naturally, different arrangements and different orientations of the discontinuous protrusions and depressions can be readily provided.

Thus, the present invention provides a plastic container having desirable aesthetic characteristics, while enabling nesting in a convenient and structurally sound configuration.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, comprising:

a blow molded plastic bottle having side portions thereof, a bottom portion thereof connected to said side portions, and a top portion thereof connected to said side portions, wherein said side portions extend downwardly from said top portion and interconnect the top portion to the bottom portion;

a pouring spout on the top portion thereof;

a handle on the top portion thereof;

wherein said top portion includes a shoulder portion, and wherein said handle extends between said pouring spout and shoulder portion;

wherein said side portions each include one of (1) at least one protrusion, (2) at least one depression, and (3) combinations thereof, which nest with one of matching protrusions and depressions of a second blow molded container of similar configuration; and wherein said bottom portion includes depressions which nest with the pouring spout, handle and shoulder portion of a second blow molded container of similar configuration.

2. A plastic container according to claim 1, wherein each side portion includes at least one protrusion and depression spaced from each other.

3. A plastic container according to claim 1, including four of said side portions to provide an essentially square container.

4. A plastic container according to claim 3, wherein each of said side portions include at least one protrusion and at least one depression spaced from each other.

5. A plastic container according to claim 1, wherein said protrusions and depressions extend laterally across said side portions.

6. A plastic container according to claim 5, wherein said protrusions and depressions are continuous and extend across at least 50% of each side portion.

7. A plastic container according to claim 5, wherein said protrusions and depressions are discontinuous and in combination extend across at least 50% of each side portion.

8. A plastic container according to claim 5, wherein said protrusions and depressions are discontinuous and extend across said side portions in end-to-end relationship.

9. A container according to claim 1, including at least one strengthening rib on each side portion.

10. A container according to claim 9, wherein said at least one rib extends laterally across each side portion.

11. A container according to claim 10, including two of said ribs on each side portion.

12. A container according to claim 1, including edge portions separating said side portions, with at least one longitudinally extending edge recess in each edge portion.

13. A plastic container according to claim 1, wherein said shoulder portion is an upstanding shoulder portion which runs perpendicular to said handle.

14. A plastic container according to claim 13, wherein said shoulder portion runs parallel to one side portion.

15. A plastic container according to claim 14, including a single pouring spout adjacent one of said side portions, a single shoulder portion adjacent a side portion opposed to the side portion adjacent the pouring spout, wherein the handle is a single handle running between the pouring spout and shoulder portion.

* * * * *